United States Patent [19]

Endres

[11] Patent Number: 4,933,600

[45] Date of Patent: Jun. 12, 1990

[54] LOW-PRESSURE MERCURY VAPOR DISCHARGE LAMP, PARTICULARLY ULTRA-VIOLET RADIATOR, ALSO PROVIDING VISIBLE LIGHT OUTPUT

[75] Inventor: Ludwig Endres, Gröbenzell, Fed. Rep. of Germany

[73] Assignee: Patent Treuhand Gesellschaft fur elektrische Gluhlampen m.b.H., Munich, Fed. Rep. of Germany

[21] Appl. No.: 230,249

[22] Filed: Aug. 9, 1988

[30] Foreign Application Priority Data

Sep. 4, 1987 [DE] Fed. Rep. of Germany ..... 3729711

[51] Int. Cl.[5] ..... H01J 61/44

[52] U.S. Cl. ..... 313/487; 252/301.4 R

[58] Field of Search ..... 313/486, 487; 252/301.4 R

[56] References Cited

U.S. PATENT DOCUMENTS

| | | | |
|---|---|---|---|
| 3,670,193 | 6/1972 | Thorington et al. | 313/487 |
| 3,764,840 | 10/1973 | Shiraishi | 313/487 |
| 4,447,756 | 5/1984 | Kohmoto et al. | 313/487 |
| 4,645,969 | 2/1987 | Hoffman | 313/487 |
| 4,683,379 | 7/1987 | Wolff | 250/493.1 |
| 4,719,033 | 1/1988 | Chenot et al. | 252/301.4 R |

FOREIGN PATENT DOCUMENTS

| | | |
|---|---|---|
| 3121689 | 12/1982 | Fed. Rep. of Germany . |
| 1326686 | 8/1973 | United Kingdom . |
| 2027266 | 2/1980 | United Kingdom . |
| 2059147 | 4/1981 | United Kingdom . |
| 2135505 | 8/1984 | United Kingdom . |

*Primary Examiner*—Sandra O'Shea

*Attorney, Agent, or Firm*—Frishauf, Holtz, Goodman & Woodward

[57] ABSTRACT

To permit visual observation of tanning effects obtained by a UV radiation lamp, the UV radiation emitting material has admixed thereto a coating material which provides auxiliary visible radiation output in the yellow-green spectral range of between about 490–600 nm. Suitable materials are: 13% of strontium aluminate, activated with cerium; 79% of barium disilicate, activated with lead; 3% of zinc silicate, activated with manganese; and 5% of calcium halogen phosphate, activated with antimony and manganese, with the spectral ranges shown in FIG. 1, or 12% of strontium aluminate, activated with cerium; 68% of barium disilicate, activated with lead; and 20% of calcium halogen phosphate, activated with antimony and manganese, with the spectral ranges shown in FIG. 2.

4 Claims, 2 Drawing Sheets

LOW-PRESSURE MERCURY VAPOR DISCHARGE LAMP, PARTICULARLY ULTRA-VIOLET RADIATOR, ALSO PROVIDING VISIBLE LIGHT OUTPUT

BACKGROUND

UV radiators to provide radiation within the UV spectrum include phosphors or similar light emitting substances having maximum radiation output in the UV range, and particularly in the A range of UV and in the long wave B range. These lamps generate "black light" and some blue light. The visible light output of the lamps does not permit observation of tanning of human skin, for example of a patient.

It has previously been proposed—see German Patent 31 21 689, Wolff—to provide a therapeutic UV radiation lamp which, besides providing UV radiation in the A range also has in addition thereto a radiation emission within the orange-red range. The orange-red emitted spectrum is intended to cancel the effect of the black-blueish light of the UV radiation, so that a balanced light output is obtained which is supposed to be "normal". The orange-red light, however, results in an over-evaluation of the red portions of the particular color composition. Since the color of the skin has many reddish components, the appearance of the skin of a patient will be pink, with a disagreeable hue. It is not possible to observe differential tanning or coloring effects of the human skin, and thus checking tanning effects of the UV radiation is not possible under light emitted by lamps of this type.

THE INVENTION

It is an object to provide a UV radiator which, in addition to generating UV radiation for irradiation of a patient, also includes light-emitting substances or luminescent substances which permit observation of the human skin, and tanning effects of the UV radiation under a light which renders the appearance of the patient's skin reasonably normal, that is, closely approaching that of ordinary white light.

Briefly, the light emitting coating within the lamp includes the normal material providing radiation in the UV range, essentially below 390 nanometers; in addition to that, a second or auxiliary material is provided which generates UV radiation in the range of between about 490 to 600 nanometers, that is, within the yellow-green spectral range.

The arrangement has the advantage that the emission of light within the yellow-green radiation range, together with those visible portions emitted by the UV luminescent material, which contains some blue components, generate an essentially white light. This light is not much different from light which is found in natural daylight; natural daylight has dominating green-yellow components. Thus, the skin of a patient will provide a reflected which approaches closely the color one would observe under natural or daylight illumination.

DRAWINGS

FIG. 1 is a graph illustrating the spectral radiation distribution of a lamp having a composition of luminescent materials, in dependence on wave length; and FIG. 2 is a diagram similar to FIG. 1 in which a different type of luminescent material is used than that illustrated in FIG. 1.

DETAILED DESCRIPTION

Mixtures are used which provide, respectively, UV radiation and green-yellow radiation output. Calcium halogen phosphate compounds, activated with antimony and manganese, are suitable for luminescent materials for the green-yellow emission. In dependence on desired color temperature, the halogen phosphate can be replaced up to 60% by a zinc silicate, activated with manganese. A lanthanum phosphate, activated with cerium and terbium, may also be used, suitably and advantageous, as a green-yellow luminescent material.

UV radiating materials, to provide radiation in the UV - A range, are, desirably, barium disilicate, activated with lead, or a strontium-barium-tetraborate, activated with europium. If tanning, to be obtained with the lamp, is to be intense, one or both of the UV - A luminescent materials may have strontium-aluminate, activated with cerium admixed thereto, so that the radiation maximum will also occur in the long wave UV - B range. This generates reddening of the skin, also observed under sunlight, and the long remanent "indirect" pigmentation is obtained.

The luminescent materials having their major emission spectrum within the green-yellow radiation range have an additional advantage. The brightness, as a physiological impression, is observed by the human eye with maximum effect within the green-yellow spectral range. Corresponding to international standards, to obtain the same brightness impression, radiation within this green spectral range (555 nm), if assigned one radiation unit, requires within the yellow range 1.15 radiation units, in the orange 1.6, and in the red spectral range 6 radiation units. This means that to obtain the same brightness impression, 6 times as much radiation substances must be mixed with the luminescent material when it radiates light within the red spectral range than when it radiation within the green spectral range. Use of luminescent materials with their main emission spectra within the green-yellow radiation range thus permits use of only small quantities of additives. This has a substantial advantage since, practically, any added light emitting substance, providing light within the visible spectral range, causes absorption of UV radiation, generated by the respective UV radiation emitting material. Thus, reducing the quantity of the added radiation emitting material within the visible spectral range permits reduction of the required quantity of material to emit radiation within the UV radiation range, or the mixture of respective materials. Thus, providing added luminescent material which radiate within the green-yellow range, the overall quantity of radiation emitting material can be held at a minimum.

Figure 1:
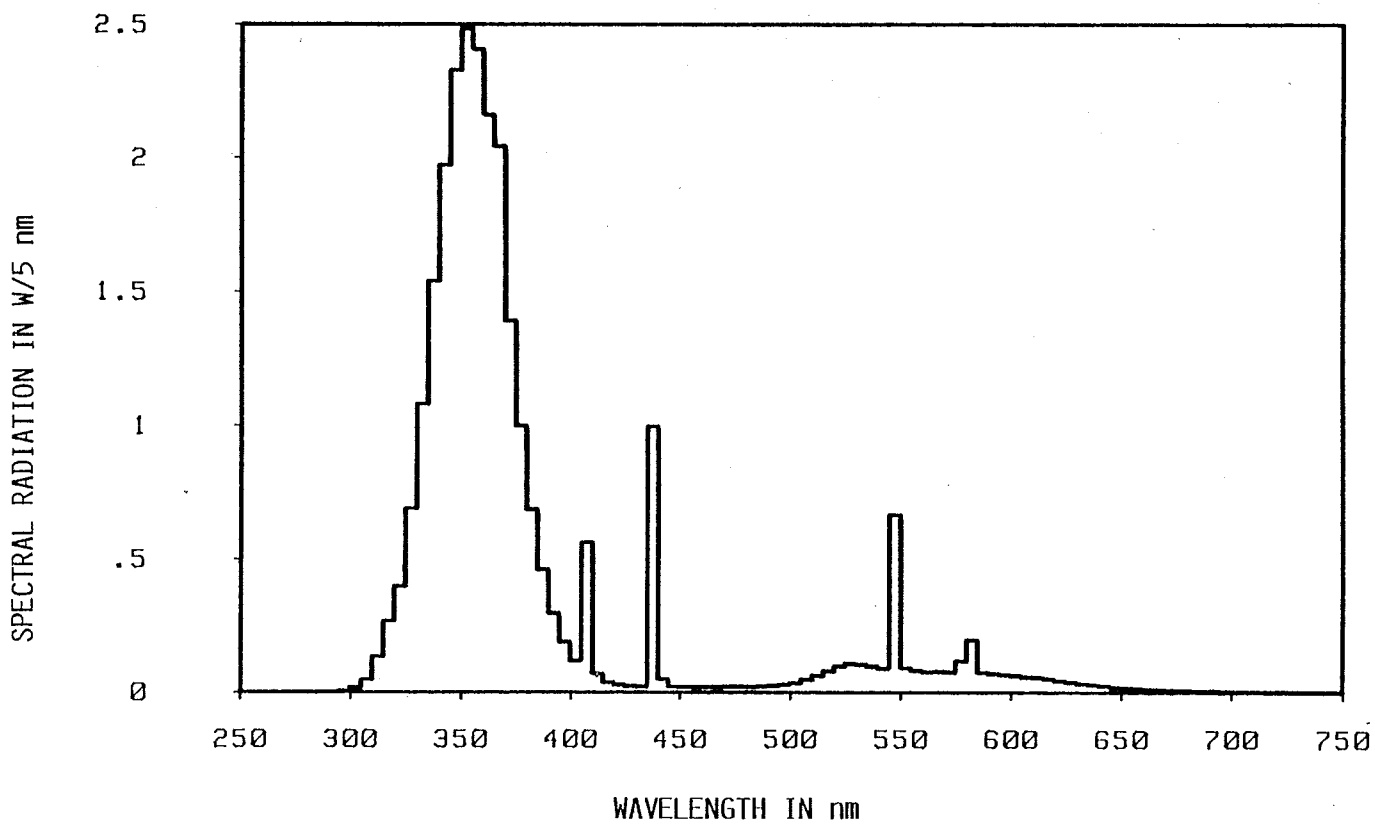

EXAMPLE 1 with reference to FIG. 1

A 100-Watt fluorescent lamp has the following mixture of luminescent material therein:

- 13% of strontium aluminate, activated with cerium;
- 79% of barium disilicate, activated with lead;
- 3% of zinc silicate, activated with manganese; and
- 5% of calcium halogen phosphate, activated with antimony and manganese.

The composition of the luminescent material generates white light with a color temperature of 7500 K.

In contrast to an illumination-type fluorescent lamp, having a luminous density of between about 1 and 2 cd/cm$^2$, the fluorescent lamp of the present invention has a luminous density of 0.25 cd/cm$^2$. Thus, the lamp, corresponding to German Industrial Standard DIN 5035, Part 1, does not cause physiological glare or blinding.

Figure 2:
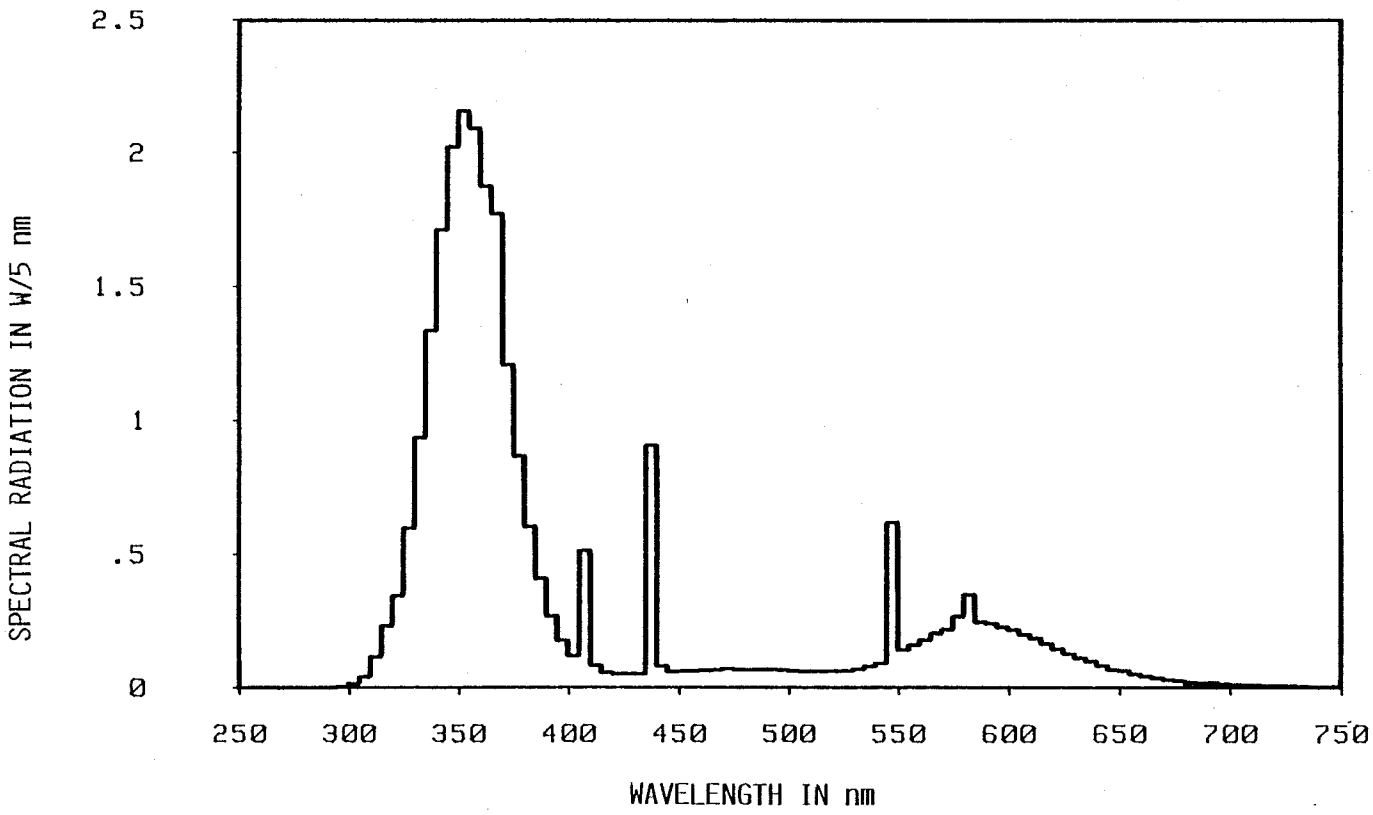

EXAMPLE 2 with reference to FIG. 2

Light emissive material of a 100 W radiation lamp had the following composition:

12% of strontium aluminate, activated with cerium;

68% of barium disilicate, activated with lead; and

20% of calcium halogen phosphate, activated with antimony and manganese.

The composition generated white light with a color temperature of 4100 K. The light, in accordance with CIE standards, has a general color rendering index Ra of 60 and a color rendering index R 13 for skin color of 57.

The radiation lamps with the radiation emitting materials of the examples have excellent radiation - biological effects and permit optimal skin irradiation, while permitting visual observation of the results. FIGS. 1 and 2 illustrate the spectral distribution of the radiation obtained from the respective examples.

Various changes and modifications may be made within the scope of the inventive concept.

I claim:

1. Low-pressure mercury discharge irradiation lamp having a radiation emitting coating which includes a first coating material providing a main radiation output in the ultraviolet (UV) range at a wave length below about 390 nm; and a second coating material providing auxiliary radiation output in the visible yellow-green spectral range of between about 490–600 nm, wherein said first coating materials include 79% of barium disilicate, activated with lead;

13% of strontium aluminate, activated with cerium; and said second coating materials include 3% of zinc silicate, activated with manganese; and 5% calcium halogen phosphate, activated with antimony and manganese, the percentages being with respect to the overall radiation emitting coating.

2. The lamp of claim 1, wherein said radiation emitting coating comprises mixtures of said first and second coating materials.

3. Low-pressure mercury discharge irradiation lamp having a radiation emitting coating which includes a first coating material providing a main radiation output in the ultraviolet (UV) range at a wave length below about 390 nm; and a second coating material providing auxiliary radiation output in the visible yellow-green spectral range of between about 490–600 nm, wherein said first coating materials include 68% of barium disilicate, activated with lead;

12% of strontium aluminate, activated with cerium; and said second coating materials includes 20% calcium halogen phosphate, activated with antimony and manganese, the percentages being with respect to the overall radiation emitting coating.

4. The lamp of claim 2, wherein said radiation emitting coating comprises mixtures of said first and second coating materials.

* * * * *